US005741053A

United States Patent [19]

Nielsen

[11] Patent Number: 5,741,053

[45] Date of Patent: Apr. 21, 1998

[54] PEDESTAL FOR UTILIZING COMPUTER HARDWARE AND ACCESSORIES

[75] Inventor: Andreas Krestian Nielsen, Del Mar, Calif.

[73] Assignee: Ladd Furniture, Inc., High Point, N.C.

[21] Appl. No.: 784,605

[22] Filed: Jan. 21, 1997

[51] Int. Cl.[6] ..... A47B 17/00

[52] U.S. Cl. ..... 312/194; 312/195; 312/196; 312/223.6; 312/311; 312/348.3

[58] Field of Search ..... 312/194, 195, 312/223.6, 348.3, 311, 196, 310

[56] References Cited

U.S. PATENT DOCUMENTS

| | | | |
|---|---|---|---|
| 1,392,998 | 10/1921 | Williams | 312/196 |
| 4,094,256 | 6/1978 | Holper et al. | 312/194 X |
| 4,325,596 | 4/1982 | Bell | 312/195 X |
| 4,755,009 | 7/1988 | Price et al. | 312/194 |
| 4,766,422 | 8/1988 | Wolters et al. | 312/194 X |
| 4,798,423 | 1/1989 | LaCour | 312/196 X |
| 5,101,736 | 4/1992 | Bommarito et al. | 312/194 X |
| 5,205,631 | 4/1993 | Wegman et al. | 312/208.1 X |
| 5,403,082 | 4/1995 | Kramer | 312/223.6 X |
| 5,558,418 | 9/1996 | Lambright et al. | 312/196 X |

OTHER PUBLICATIONS

The Summerland Goup Inc., The Office CEO and Professional models, manufactured by Tarrant Interiors, Inc., Aug. 1996.

Ameriwood Furniture, Ameriwood Multimedia Armoire, advertised in Office Max brochure, Aug. 1996.

*Primary Examiner*—Peter M. Cuomo
*Assistant Examiner*—Hanh V. Tran
*Attorney, Agent, or Firm*—Kilpatrick Stockton LLP

[57] ABSTRACT

A desk pedestal for storing computer hardware and ancillary computer equipment and supplies which is specifically designed to hold and provide ready access to either a vertical tower or a horizontal central processing unit (CPU) and includes a built-in master power director for cord management and a hidden rear access means for easy installment of the hardware and ready accessibility to cords and other potential computer related problems. The desk pedestal may be used in either a desk or armoire and includes first and second interior compartments and at least one adjustable shelf which allows the user to choose between storing a vertical tower or horizontal CPU by adding or removing the adjustable shelf to create a compartment which is specifically dimensioned for storing either unit. The second compartment of the desk pedestal is designed to hold a plurality of slidable drawers specifically adapted for storing computer diskettes, CDs and miscellaneous items. The unique arrangement of the compartments and adjustable shelves of the pedestal enable the user to have quick and easy access to the stored items for optimal usage of the computer hardware and ancillary computer equipment and supplies.

32 Claims, 4 Drawing Sheets

PEDESTAL FOR UTILIZING COMPUTER HARDWARE AND ACCESSORIES

BACKGROUND OF INVENTION

1. Field of Invention

The subject invention is generally related to desk components and is specifically directed to a desk pedestal for storing and providing ready access to computer hardware and ancillary computer equipment and supplies for complete utility of the same.

2. Description of the Prior Art

With technological advances, a tremendous number of individuals in businesses and offices are utilizing personal computer systems on a daily basis. Today's state-of-the-art computer systems typically include CD ROMs and other ancillary computer equipment, and perform a multitude of functions, such as transmitting phone and fax messages. While technological advances have provided state-of-the-art computer systems, conventional desks are not designed to store today's computer hardware and ancillary computer equipment so that it is readily accessible and easily utilized.

A variety of computer work stations for storing computer equipment are known. Examples of various types of computer work stations are U.S. Pat. No. 5,558,418 issued to Lambright, et al.; U.S. Pat. No. 5,408,939 issued to Lechman on Apr. 25, 1995; U.S. Pat. No. 5,403,082 issued to Kramer; U.S. Pat. No. 5,364,177 issued to Ugalde on Nov. 15, 1994; and U.S. Pat. No. 5,101,736 issued to Bommarito, et al. on Apr. 7, 1992. While the computer work stations are typically designed to accommodate and store a computer monitor, keyboard and printer for providing an uncluttered work surface, none of the computer work stations are designed to provide the user with the complete organization, management and utility of today's computer hardware, ancillary computer equipment and supplies in a desk with a conventional appearance.

Therefore, there is a need for a desk component for storing and providing utilitarian usage of a variety of available computer hardware and accessories, including storing of computer diskettes and compact disks in a compact disk dust-proof case.

SUMMARY OF THE INVENTION

The subject invention is directed to a desk pedestal for storing computer hardware and accessories which is specifically designed to hold and provide ready access to either a vertical tower or a horizontal central processing unit (CPU) and includes a built-in master power director for centralizing the computer and phone lines for facilitating cord management and for complete organization and utility of the computer hardware and accessories. The desk pedestal supports a desk top and includes interior compartments with adjustable shelves and storage drawers specifically dimensioned for storing either a vertical tower or horizontal CPU, computer diskettes, and a compact disk (CD) case. The unique arrangement of the compartments and adjustable shelves of the pedestal enable the user to have quick and easy access to the stored items for optimal usage of the computer hardware and ancillary computer equipment and supplies while maintaining the appearance of a conventional desk, such as a wooden desk.

The desk pedestal of the subject invention also includes a rear entry access means, such as, by way of example, a hidden door panel, which makes hook-up for the hardware easy and provides the user with quick access to computer cables and phone lines and other potential computer related problems without having to remove the computer hardware from the pedestal. The rear door panel includes a touch latch for providing a hidden means for opening the door by pushing the door inward and may include an opening in the panel for the power cord to extend to the wall outlet. Because of its unique configuration and inclusion of a built-in master power director and hidden rear access means, the pedestal helps to organize computer essentials and eliminates the necessity of having several electrical cords/phone lines extending from the user's desk to the wall electrical outlet by promoting cord management of the computer and phone lines with only one cord extending from the pedestal's master power director to the wall electrical outlet. Thus, the desk pedestal reduces desk top and cord clutter and provides an easily utilized, highly efficient computer work station with the appearance of a conventional desk.

In the preferred embodiment, the interior portion of the desk pedestal includes a fixed shelf at a predetermined height and a fixed, intermediate vertical partition which connects with the fixed shelf to define first and second compartments within the pedestal's interior. The pedestal of the subject invention includes at least one adjustable horizontal shelf for customizing the interior compartments to store either a vertical tower or a horizontal CPU. If the user chooses to install a horizontal CPU, the adjustable shelf is added and adjoins the fixed shelf to provide a continuous, horizontal shelf dimensioned to support the horizontal CPU. A second adjustable shelf may be added to provide an additional storage shelf in the interior portion of the pedestal. If the user chooses to store a vertical tower, both shelves are removed and the remaining space is perfectly dimensioned to store the tower unit. In addition to customizing the pedestal for either a vertical or horizontal CPU, the adjustable shelves allow for versatility to store and provide quick access to commonly used peripheral equipment, such as a CD ROM or a modem.

The subject invention also includes a third compartment which is specifically designed to house the master power director. In the preferred embodiment, the third compartment of the pedestal houses a built-in vertical power pack having six switches located on the front with corresponding outlets on the back, including two telephone lines. The inclusion of two telephone lines allows the user to dedicate one line to data communication while the other line is dedicated to voice communication. Thus, the user does not have to switch a single telephone line back and forth between the two functions. The preferred vertical power pack provides for cord management of the computer and phone lines. In the preferred embodiment of the subject invention, the second compartment of the desk pedestal includes a series of slidable drawers for accessibly storing computer diskettes, CDs and miscellaneous items typically used by a computer operator. The compartment is designed to have three narrow pull out drawers, one for pencils and other miscellaneous supplies which is important since the conventional center storage drawer for miscellaneous supplies is typically replaced in a desk designed for use with computers by a keyboard pullout. The two remaining narrow drawers are for diskette storing trays which hold up to 45 diskettes per tray. In addition, the compartment includes one wider drawer for storing a dust-proof CD case which holds up to 24 CDs. Thus, the desk pedestal of the subject invention is specifically designed for a computer user and provides a compartment designed to hold computer-related items and necessary storage space for miscellaneous supplies for enhancing the effectiveness and efficiency of the use of the pedestal. In addition, the pedestal of the subject invention may include a hinged front door on the front of the pedestal facing the user which includes a decorative panel with false drawer fronts so that when the door is closed, the pedestal appears to have a number of storage drawers, as is typical on a conventional desk.

Therefore, it is an object and feature of the subject invention to provide a desk pedestal for storing and providing utilitarian usage of computer hardware and accessories while maintaining the appearance of a conventional desk.

It is another object and feature of the subject invention to provide a desk pedestal which includes specifically dimensioned compartments which allow the user to choose either horizontal or vertical storage of a CPU and includes a built-in power director for cord management and a hidden rear access means for easy installment of the hardware and ready accessibility to cords and other potential computer related problems.

It is yet another object and feature of the subject invention to provide a desk pedestal including an adjustable shelf which allows the user to choose between storing a vertical tower or horizontal CPU by adding or removing the adjustable shelf to create a compartment which is specifically dimensioned for storing either unit.

It is yet another object and feature of the subject invention to provide a desk pedestal which includes a compartment designed to hold slidable drawers for storing computer diskettes, CDs and miscellaneous items.

It is yet another object and feature of the subject invention to provide a desk pedestal which includes a second adjustable shelf for providing additional shelf space when a horizontal CPU is stored within the pedestal.

It is yet another object and feature of the subject invention to provide a desk pedestal which includes a master power director with a plurality of switches located on the front with corresponding outlets on the back, including two phone lines.

Other objects and features will be readily apparent from the accompanying drawings and description.

DETAILED DESCRIPTION OF THE DRAWINGS

Figure 1:
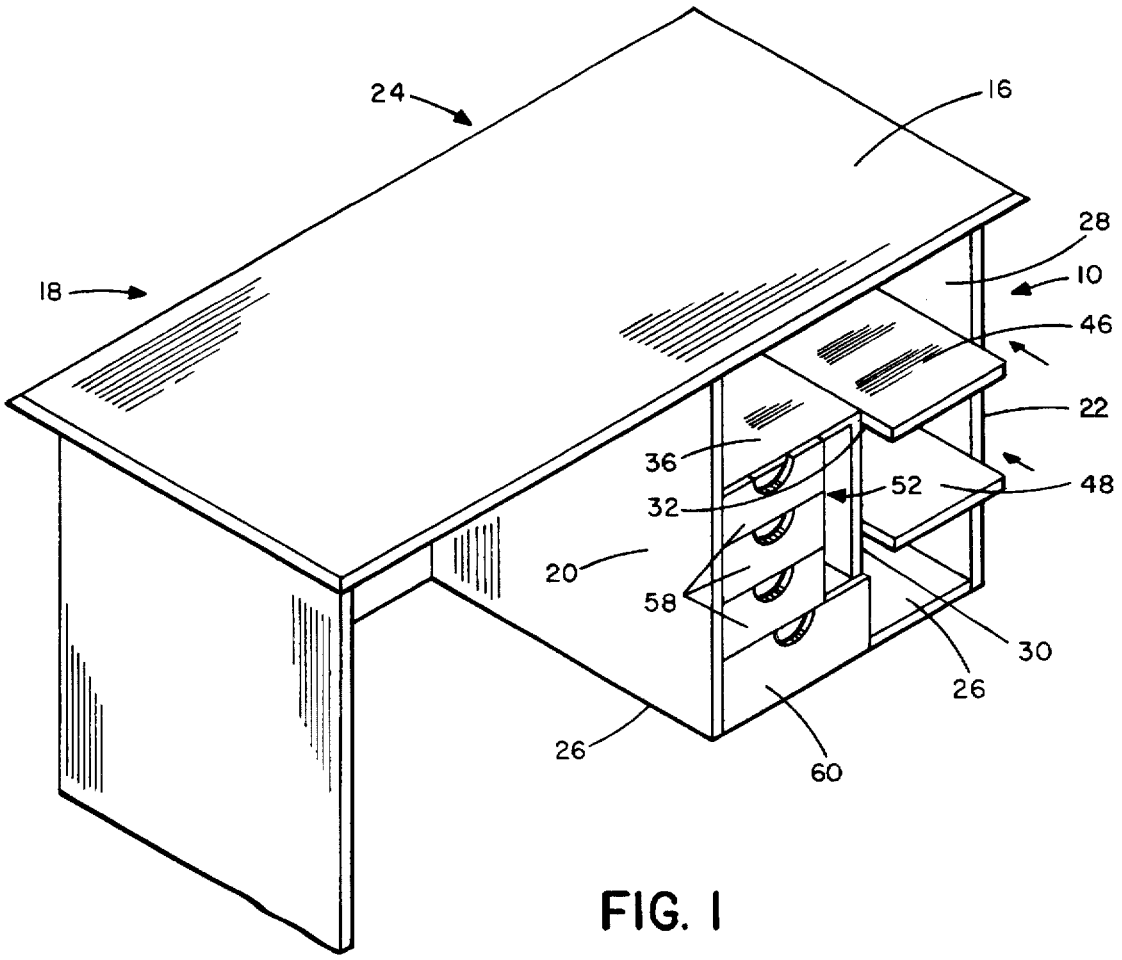
FIG. 1 is a perspective view of the desk pedestal supporting a right-hand side of a desk top of a desk showing the compartments in the interior of the pedestal and adjustable shelves being added.
Figure 4:
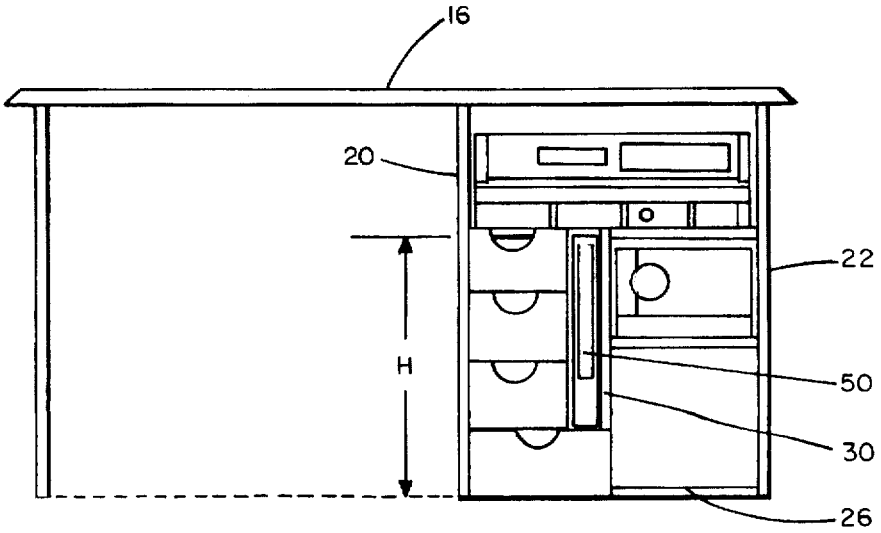
FIG. 4 is a front view of the desk and desk pedestal with the adjustable shelves added and storing a horizontal CPU and showing the configuration of the slidable drawers and master power director.

Referring to FIGS. 1–7, the pedestal of the subject invention is designated generally by the reference numeral 10 and is specifically designed for storing either a vertical tower 12 or horizontal CPU 14 and ancillary computer equipment and supplies, such as a CD ROM, modules, computer diskettes and CDs and for providing a user with ready access to the computer hardware and accessories and facilitating cord management. The desk pedestal 10 supports a desk top 16 of a desk 18 and includes a substantially rectangular-shaped structure or box formed by first and second spaced-apart, opposite side walls 20, 22, a rear wall 24 perpendicular to and connecting the side walls 20, 22, and a base 26 adjacent to a floor supporting the pedestal. In the preferred embodiment, each side wall 20, 22 is positioned parallel to the other laterally, spaced-apart upstanding side wall and has a front edge at the open front wall of the pedestal 10, a back edge connected to the rear wall 24, a top edge adjacent to and supporting the desk top 16 and a bottom edge attached to the base 26. The rectangular-shaped box is further supported by a top back rail 23 on the top edge of the rear wall 24 and a top front rail 25 on the top edge of the open front wall, each rail extending across the back and front, respectively, from side wall 20 to side wall 22. In the preferred embodiment, the top front rail 25 includes a pullout tray 29 with recessed mouse pad 31.

Figure 2:
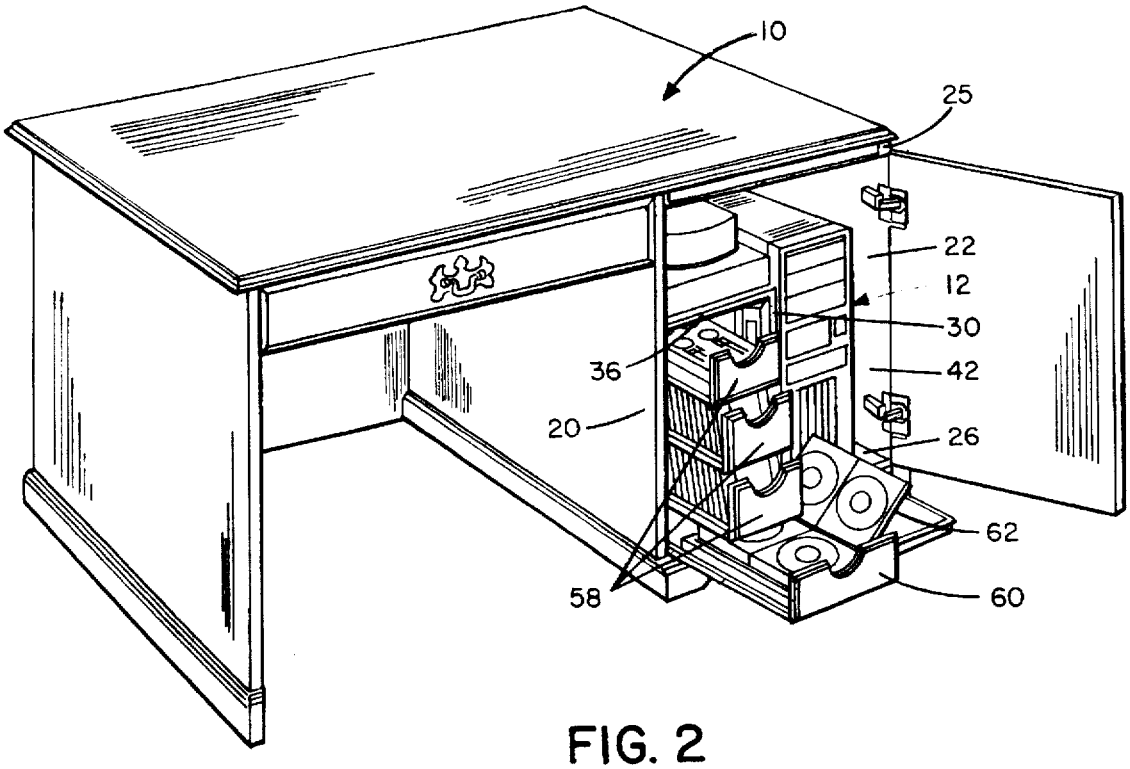
FIG. 2 is a perspective view of the desk pedestal with the adjustable shelves removed and storing a vertical tower therein and peripheral computer equipment on the fixed shelf, and showing the master power director and the slidable drawers including a pencil tray, computer diskette storage trays and a dust-proof CD case.

The desk pedestal 10 of the subject invention includes a substantially rectangular-shaped, hollow interior 28 and an open front wall which provides access to the interior 28. As shown, the subject invention comprises an intermediate, fixed vertical divider or partition 30 having a top end 32 and a bottom end 34 and extending from the base 26 to a pre-determined height H within the interior 28. A fixed, horizontally disposed half shelf 36 having opposite ends 38, 40, extends from the first side wall 20 to the partition 30. One end 38 of the fixed half shelf 36 is secured to the first side wall 20 while the top end 32 of the partition 30 provides support for the other end 40. As shown, a first interior compartment 42 is formed between the vertical partition 30 and the second side wall 22 and is specifically dimensioned for storing a vertical tower 12. In addition, a second interior compartment 44 is formed between the vertical partition 30 and the first side wall 20 and has a top defined by the fixed half shelf 36. When a vertical tower is stored in the first compartment 42, the fixed half shelf 36 provides for peripheral storage, such as storage for a CD ROM or a module or the like, as shown in FIG. 2.

Figure 3:
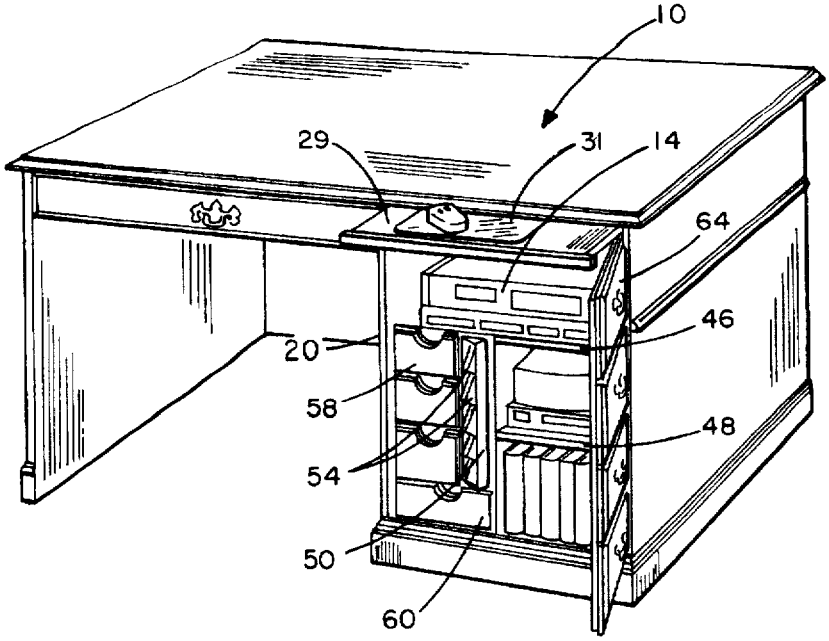
FIG. 3 is a perspective view of the desk pedestal with the adjustable shelves added and storing a horizontal CPU and peripheral computer equipment therein, and showing the master power director, the pull-out tray with a recessed mouse pad, and the drawers including a pencil tray, computer diskette storage trays and a dust-proof CD case.
Figure 5:
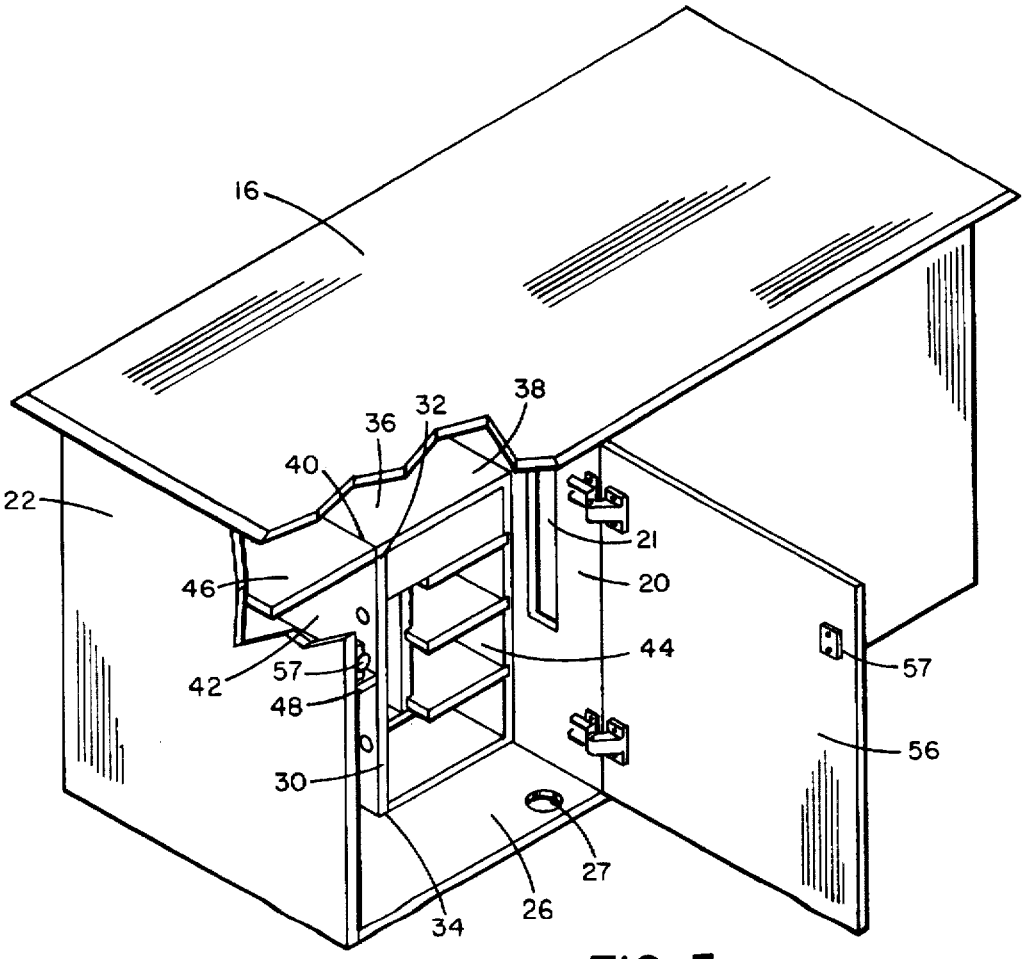
FIG. 5 is a rear view of the desk pedestal showing the hidden rear door panel for quick rear access entry to the interior of the pedestal and computer hardware stored therein.

While the pedestal is specifically designed for storing a vertical tower, it is a feature of the subject invention that the pedestal is also specifically designed for storing a horizontal CPU and is easily converted for either use by adding or removing an adjustable half shelf 46. In use, the adjustable half shelf 46 is positioned directly adjacent to the fixed half shelf 36 and extends from the second side wall 22 to the top end 32 of the vertical partition 30. To add the adjustable half shelf 46, the user slides the shelf into the space next to the fixed half shelf 36. In order to support the half shelf 46 in place, the vertical partition 30 includes a pair of spaced holes directly below the fixed shelf 36 and facing the first compartment 42, and the second side wall 22 includes a pair of corresponding space holes directly across from and facing the spaced holes in the vertical partition 30. A pin is adapted to be inserted into and fit snugly into each of the holes and is inserted into the holes for supporting the adjustable shelf 46 in position. The fixed half shelf 36 and adjustable half shelf 46 join together to form a continuous horizontal shelf surface which extends from the first side wall 20 to the second side wall 22 for supporting a horizontal CPU placed on the shelves 36, 46 (See FIG. 3). When a horizontal CPU is stored in the pedestal 10, a second adjustable shelf 48 may be added between the vertical partition 30 and second side wall 22 beneath the adjustable shelf 46 to provide for peripheral storage, such as storage for a CD ROM or a module or the like, as shown in FIG. 3). The second adjustable shelf 48 is supported by the shelf pins in the same manner as the shelf pins supporting adjustable shelf 46. As shown in FIG. 5, the vertical partition 30 and second side wall 22 include at least four holes for inserting the shelf pins. The subject invention is specifically directed to a desk pedestal 10 having a unique interior configuration for providing quick access to computer hardware and accessories and which is easily customized to be specifically dimensioned for storing either a vertical tower or horizontal CPU.

Figure 6:
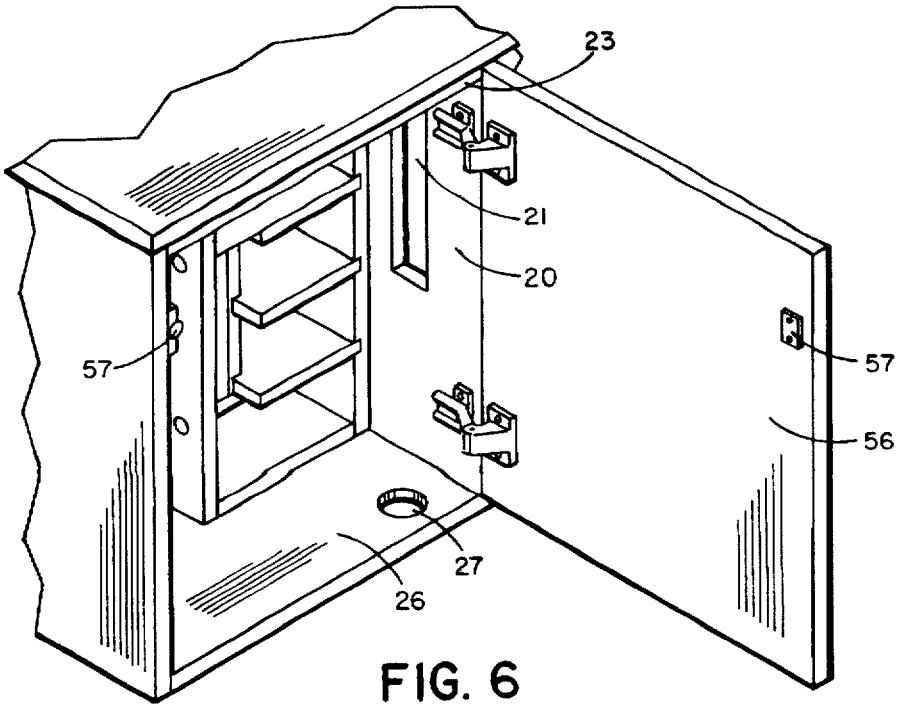
FIG. 6 is an enlarged view of the rear door panel showing the touch latch which provides a hidden means for opening the panel for quick rear entry access to the pedestal.
Figure 7:
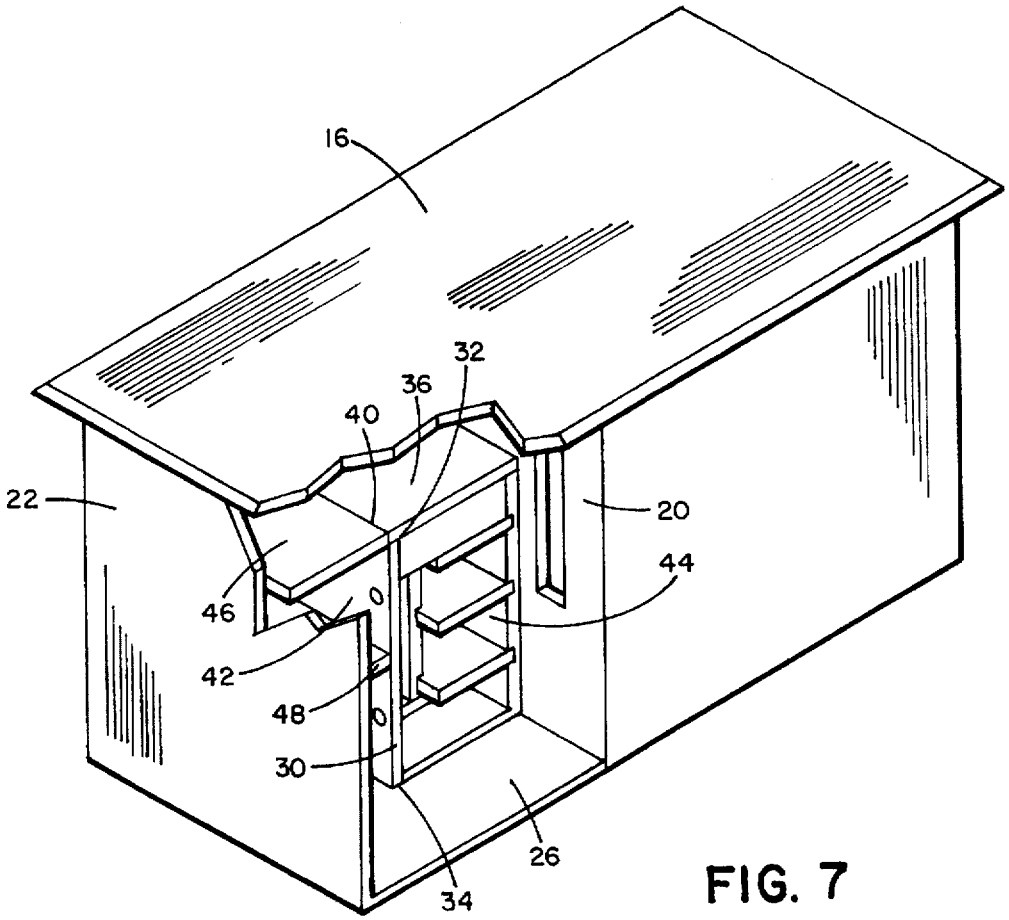
FIG. 7 is a rear view of the desk pedestal showing an alternative rear access means with the rear wall removed to provide an opening to the rear of the pedestal.

In addition to giving the user the option of storing either a vertical tower or horizontal CPU, the pedestal 10 of the subject invention provides for cord management of the computer and phone lines by including a master power director 50 contained in a third compartment or power box 52. As best seen in FIG. 1, the third compartment 52 is a narrow, vertical chamber positioned in the second compartment 44 adjacent to the vertical partition 30. The master power director 50 includes component switches 54 located on the front with corresponding outlets on the back (not shown). In the preferred embodiment, the master power director 50 is a vertical power pack, built into the third compartment 52 with an individual master switch and five individual component switches, including two phone lines for providing a separate line which may be dedicated to data communication such as, analog or digital communication along with another separate line for voice communication. As shown in FIGS. 5, 6, the base 26 of the compartment may include a through hole 27 for providing an exit from the interior of the pedestal for the cord extending from the master power director 50 to the wall outlet. In addition, the side wall 20 may include an opening 21, for providing access to the interior of the pedestal for telephone lines and electrical cords as needed. (see FIG. 5).

Another feature of the pedestal 10 of the subject invention is a hidden rear access means to make hook-up and repair of the computer hardware easy and accessible. As shown in FIG. 5, the rear wall 24 may be a hidden, hinged door panel 56 which may be opened and closed by the user as desired to gain rear entry access to the interior 28 of the pedestal 10 and to the cords and other potential computer related problems. In the preferred embodiment, the rear door panel includes a touch or spring latch 57 near the top corner of the rear door panel 56 for providing a hidden means for opening the rear door panel 56 and accessing the interior of the pedestal (see FIG. 6). The touch latch 57 is a magnetic spring latch which springs open when pressed to open the rear door panel 56, such as, by way of example, the latch typically included on stereo and television cabinet doors. In addition, the rear door panel 56 may include through opening (not shown) for providing an exit from the interior of the pedestal for the cord extending from the master power director 50 to the wall outlet. Alternatively, the rear wall 24 may be omitted leaving the rear of the pedestal open for easy access (see FIG. 7).

In order to provide convenient storage for computer diskettes, compact disks (CDs) and other computer accessories, the second compartment 42 of the pedestal includes at least one pullout drawer. In the preferred embodiment, the pedestal 10 includes three narrow, slidable drawers 58 and a wider drawer 60. The preferred narrow drawers 58 include two drawers comprising diskette storage trays which hold up to 45 diskettes per tray and a third narrow drawer for miscellaneous items, such as pens and pencils. While the third narrow drawer is not specifically configured to hold computer supplies, the drawer acts as a storage place for items which are usually placed in a center desk drawer which is typically now replaced by a keyboard pullout in a desk designed for a computer user. The preferred wider drawer 60 is designed to carry a dust-proof CD case 62 which holds up to 24 CDs. In the subject invention, a hinged front door 64 conceals the interior compartments 42, 44 and computer hardware and accessories from view when not in use. The front door 64 preferably includes a decorative door panel, such as, by way of example, decorative false drawer fronts with drawer handles.

Figure 8:
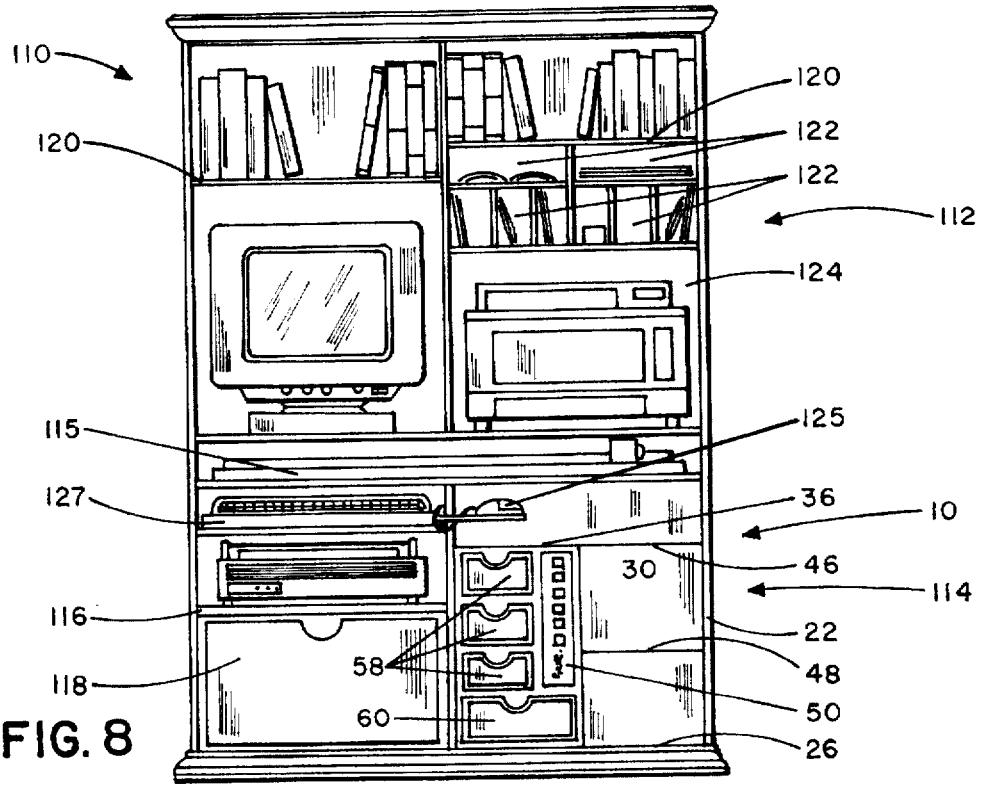
FIG. 8 is an alternative view of the desk pedestal showing the pedestal in an armoire designed for storage of computer hardware and ancillary computer equipment and supplies.

In an alternative embodiment of the subject invention, the pedestal 10 is included in a tall shelved unit or armoire 110 as shown in FIG. 8. The armoire 110 includes an upper section 112, a lower section 114 and a pull-out work surface 115 between the upper and lower sections 112, 114. The pedestal 10 is included on one side of the lower section 114 while the remaining space of the lower section may include a shelf 116 and a file drawer 118. The upper section 112 may include at least one adjustable book shelf 120, storage slots 122 and a compartment 124 for a printer (see FIG. 8). The armoire 110 may also include a right or left mouse slide-out 125 and a keyboard pull-out 127. When not in use, the armoire 110 includes armoire doors (not shown) which may be closed to conceal the interior of the armoire 110.

As in the preferred embodiment, the pedestal 10 in the armoire 110 of the alternative embodiment is specifically designed to store either a vertical tower or a horizontal CPU and is easily converted for either use by adding or removing an adjustable half shelf 46. When a vertical tower is stored in the first compartment 42, the fixed half shelf 36 provides for peripheral storage, such as storage for a CD ROM or a module or the like. When a horizontal CPU is stored in pedestal 10, a second adjustable shelf 48 may be added between the vertical partition 30 and second side wall 22 beneath the adjustable shelf 46 to provide for peripheral storage, such as storage for a CD ROM or a module or the like. In addition, the pedestal 10 facilitates cord management by including a master power director 50 contained in a third compartment or power box 52. As in the preferred embodiment, the master power director 50 of the alternative embodiment is a vertical power pack built into the third compartment and having an individual master switch and five individual component switches, including two phone lines. As shown in FIG. 8, the pedestal 10 of the alternative embodiment includes three narrow, slidable drawers 58 and a wider drawer 60. The preferred narrow drawers 58 include two drawers comprising diskette storage trays which hold up to 45 diskettes per tray and a third narrow drawer for miscellaneous items, such as pens and pencils. The wider drawer 60 is designed to carry a dust-proof CD case which holds up to 24 CDs. Because the armoire 110 is intended to be positioned with the back of the armoire against a wall, there is an open rear wall (not shown) which allows for easy rear access to the interior of the pedestal 10 and to the cords and other potential computer related problems. Thus, the subject invention provides a pedestal for either a desk or an armoire with a unique, adjustable, interior configuration which optimizes the available interior storage space of the desk pedestal for storing and utilizing computer hardware and accessories.

While specific embodiments and features of the invention have been disclosed herein, it will be readily understood that the invention encompasses all enhancements and modifications within the scope and spirit of the following claims.

What is claimed is:

1. A pedestal for storing and readily utilizing computer hardware and ancillary computer equipment and supplies, said pedestal including:

a. first and second spaced-apart, opposite side walls and a base, said walls and base defining a substantially rectangular-shaped structure having a hollow interior and an open front wall;

b. an intermediate, fixed, vertical partition extending from the base to a pre-determined height within the interior portion, said vertical partition having a top end and a bottom end;

c. a fixed half shelf extending from the first side wall at a predetermined height to the top end of the vertical partition;

d. a first interior compartment formed between the vertical partition and the second side wall, said first interior compartment being specifically dimensioned for storing a vertical tower;

e. an adjustable half shelf positionable directly adjacent to the fixed half shelf and extending from the second side wall to the top end of the vertical partition and being removable therefrom, wherein said fixed half shelf and said adjustable shelf join together to define a horizontal shelf surface extending from the first side wall to the second side wall for storing a horizontal CPU; and f. wherein said interior is easily customized to be specifically dimensioned for storing either a vertical tower or a horizontal CPU by selectively removing or adding the adjustable half shelf.

2. The pedestal of claim 1, wherein said horizontal shelf surface formed by the fixed half shelf and said adjustable half shelf is specifically dimensioned to accommodate a horizontal CPU.

3. The pedestal of claim 1, said interior further including a second interior compartment formed between the vertical partition and the first side wall and having a top defined by the fixed half shelf.

4. The pedestal of claim 3, said second interior compartment having at least one slidable drawer for storing supplies and computer accessories.

5. The pedestal of claim 4, said second compartment having a plurality of slidable drawers including at least one drawer adapted for storing computer diskettes.

6. The pedestal of claim 5, wherein said second compartment further includes at least one drawer for storing compact disks.

7. The pedestal of claim 4, said second compartment having a plurality of slidable drawers including at least one wider drawer adapted for storing compact disks.

8. The pedestal of claim 6, wherein said wider drawer includes a compact disk dust-proof case.

9. The pedestal of claim 1, further including a rear wall, a top back rail on the top edge of the rear wall and a top front rail on the top edge of the open front wall, said rails having opposite outer ends and extending across the top of the rear wall and open front wall with one end of each rail at the first side wall and the other end of each rail at the second side wall.

10. The pedestal of claim 9, further including a pull-out tray on the top front rail, said pull-out tray extendable from a retracted position within the interior of the pedestal and an extended position over the top front rail and outward from the open front wall of the pedestal.

11. The pedestal of claim 10, wherein said pull-out tray includes a recessed mouse pad.

12. The pedestal of claim 1, said interior further including a central power unit/master power director for centralizing the sources providing power to the computer hardware and ancillary computer equipment.

13. The pedestal of claim 12, wherein said second compartment further includes a third compartment adapted to house the central power unit/master power director, said central power unit/master power director being secured in the third compartment.

14. The pedestal of claim 13, wherein said central power unit/master power director has a front panel and a back panel, said front panel including a plurality of switches for controlling the power source to the computer hardware and ancillary computer equipment.

15. The pedestal of claim 14, wherein said central power unit/master power director is a vertical power pack.

16. The pedestal of claim 12, said first interior compartment further including a second adjustable shelf positionable between said vertical partition and said second side wall for providing additional shelf storage space.

17. The pedestal of claim 16, further including a hinged front door positioned to cover the open front wall for concealing the interior of the pedestal.

18. The pedestal of claim 1, further including a rear wall connecting said side walls, said rear wall including a rear access means for providing quick and easy access to the interior and to the computer hardware and ancillary computer equipment stored therein.

19. The pedestal of claim 18, wherein said rear wall comprises a hinged rear door panel.

20. The pedestal of claim 19, said rear door panel further including a hidden latching means for providing a hidden means for maintaining the rear door in a closed position and opening the rear door to provide access to the interior of the pedestal.

21. The pedestal of claim 20, wherein said hidden latching means is a spring latch whereby said spring latch springs open when the rear door panel is pressed against the latch to open the rear door panel.

22. A desk having a desk top and at least one pedestal supporting said desk top, said pedestal comprising:

a. first and second spaced-apart, opposite side walls and a base, said walls and base defining a substantially rectangular-shaped structure having a hollow interior and open front wall;

b. an intermediate, fixed, vertical partition extending from the base to a pre-determined height within the interior portion, said vertical partition having a top end and a bottom end;

c. a fixed half shelf extending from the first side wall at a predetermined height to the top end of the vertical partition;

d. a first interior compartment formed between the vertical partition and the second side wall, said first interior compartment being specifically dimensioned for storing a vertical tower;

e. an adjustable half shelf positionable directly adjacent to the fixed half shelf and extending from the second side wall to the top end of the vertical partition and being removable therefrom, wherein said fixed half shelf and said adjustable shelf join together to define a horizontal shelf surface extending from the first side wall to the second side wall for storing a horizontal CPU; and f. wherein said interior is easily customized to be specifically dimensioned for storing either a vertical tower or a horizontal CPU by selectively removing or adding the adjustable half shelf.

23. The desk of claim 22, said pedestal further comprising a built-in central power unit/master power director in the interior for centralizing power source and providing cord management of the computer lines.

24. The desk of claim 22, said pedestal further comprising a second compartment formed between the vertical partition and the first side wall and having a top defined by the fixed half shelf and including at least one slidable drawer for storing supplies and computer accessories.

25. The desk of claim 24, said second compartment including a plurality of slidable drawers including at least one drawer adapted for storing computer diskettes and one drawer adapted for storing compact disks.

26. The desk of claim 22, further including a rear wall, wherein said rear wall includes a rear access means for providing quick and easy access to the interior and to the computer hardware and ancillary computer equipment stored therein.

27. The desk of claim 22, wherein said rear wall has opposite sides and one side being hinged to the adjacent side wall for opening and closing said rear wall to provide quick and easy access to the interior.

28. An armoire including a pedestal for storing and readily utilizing computer hardware and ancillary computer equipment and supplies, said pedestal including:

a. first and second spaced-apart, opposite side walls and a base, said walls and base defining a substantially rectangular-shaped structure having a hollow interior and an open front wall;

b. an intermediate, fixed, vertical partition extending from the base to a pre-determined height within the interior portion, said vertical partition having a top end and a bottom end;

c. a fixed half shelf extending from the first side wall at a predetermined height to the top end of the vertical partition;

d. a first interior compartment formed between the vertical partition and the second side wall, said first interior compartment being specifically dimensioned for storing a vertical tower;

e. an adjustable half shelf positionable directly adjacent to the fixed half shelf and extending from the second side wall to the top end of the vertical partition and being removable therefrom, wherein said fixed half shelf and said adjustable shelf join together to define a horizontal shelf surface extending from the first side wall to the second side wall for storing a horizontal CPU; and f. wherein said interior is easily customized to be specifically dimensioned for storing either a vertical tower or a horizontal CPU by selectively removing or adding the adjustable half shelf.

29. The armoire of claim 28, wherein said horizontal shelf surface formed by the fixed half shelf and said adjustable half shelf is specifically dimensioned to accommodate a horizontal CPU.

30. The armoire of claim 28, said interior further including a second interior compartment formed between the vertical partition and the first side wall and having a top defined by the fixed half shelf, said second interior compartment having at least one slidable drawer for storing supplies and computer accessories.

31. The armoire of claim 28, said interior further including a central power unit/master power director for centralizing the sources providing power to the computer hardware and ancillary computer equipment.

32. The pedestal of claim 31, wherein said central power unit/master power director is a vertical power pack.

* * * * *